US005190232A

United States Patent [19]

Brandon et al.

[11] Patent Number: 5,190,232

[45] Date of Patent: Mar. 2, 1993

[54] WIND-UP LAY-ON-ROLL APPARATUS

[75] Inventors: Noel C. Brandon, Manalapan; Leonard N. Jenkins, New Brunswick, both of N.J.

[73] Assignee: E. I. Du Pont de Nemours and Company, Wilmington, Del.

[21] Appl. No.: 610,440

[22] Filed: Nov. 13, 1990

[51] Int. Cl.[5] ..... B65H 18/08; B65H 23/10

[52] U.S. Cl. ..... 242/56 A; 242/64; 242/67.10 R; 242/75.2

[58] Field of Search ..... 242/56 A, 64, 75.2, 242/67.1 R

[56] References Cited

U.S. PATENT DOCUMENTS

| | | | |
|---|---|---|---|
| 2,943,806 | 7/1960 | Phelps | 242/56 A |
| 3,279,716 | 10/1966 | Huck | 242/56 A |
| 3,329,368 | 7/1967 | Mastriani | 242/56.2 |
| 3,345,009 | 10/1967 | Rockstrom | 242/56 A |
| 3,346,209 | 10/1967 | Cronin | 242/66 |
| 3,478,975 | 11/1969 | Penrod | 242/64 |
| 3,599,889 | 8/1971 | Pfeiffer | 242/66 |
| 3,630,462 | 12/1971 | Nordgren | 242/64 |
| 3,650,490 | 3/1972 | Saunders | 242/75.3 |
| 3,670,980 | 6/1972 | Mukai et al. | 242/67.1 |
| 3,837,593 | 9/1974 | Dörfel | 242/66 |
| 3,858,820 | 1/1975 | Crouse | 242/66 |
| 3,977,619 | 8/1976 | Nagata et al. | 242/67.1 R |
| 4,150,797 | 4/1979 | Kataoka | 242/67.1 R |
| 4,180,216 | 12/1979 | Dahl et al. | 242/66 |
| 4,343,440 | 8/1982 | Engl | 242/67.1 R |
| 4,431,140 | 2/1984 | Tetro | 242/64 X |
| 4,524,919 | 6/1985 | Wehrmann | 242/67.1 R |
| 4,535,950 | 8/1985 | Lisnyansky | 242/66 |
| 4,541,583 | 9/1985 | Forman et al. | 242/56 A |
| 4,552,317 | 11/1985 | Halter | 242/75.2 X |
| 4,598,877 | 7/1986 | Oinonen | 242/66 |
| 5,035,373 | 7/1991 | Perrigo | 242/56 A |
| 5,054,707 | 10/1991 | Olson | 242/67.1 R X |

FOREIGN PATENT DOCUMENTS

| | | | |
|---|---|---|---|
| 0211313 | 2/1987 | European Pat. Off. . | |
| 0292451 | 11/1988 | European Pat. Off. . | |
| 0162659 | 6/1989 | Japan | 242/67.1 R |

OTHER PUBLICATIONS

Patent Abstracts of Japan vol. 14, No. 319 (M-996) (4262) Jul. 9, 1990 & JP-A-2 106 542 (Toray Ind Inc) Apr. 18, 1990.

Patent Abstracts of Japan vol. 13, No. 526 (M-897) (3874) Nov. 22, 1989 & JP-A-1 214 559 (Nishimura Seisakusho K.K.) Aug. 28, 1989.

Patent Abstracts of Japan vol. 13, No. 206 (M-826) (3554) May 16, 1989 & JP-A-1 028 149 (Ishikawajima Harima Heavy Ind Co Ltd) Jan. 30, 1989.

*Primary Examiner*—Daniel P. Stodola
*Assistant Examiner*—William Stryjewski
*Attorney, Agent, or Firm*—John E. Griffiths

[57] ABSTRACT

An apparatus for supporting a wind-up lay-on roll and, in particular, where the apparatus enables the wind-up lay-on roll to apply a substantially uniform force across a width of web material being wound into a roll on a turret assembly.

10 Claims, 8 Drawing Sheets

WIND-UP LAY-ON-ROLL APPARATUS

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

This invention relates to an apparatus and method for supporting a wind-up lay-on roll and, in particular, where the apparatus and method enables the wind-up lay-on roll to apply a substantially uniform force across a width of web material being wound into a roll on a turret assembly.

2. Description of Related Art

When a sheet 2 of webbed material is wound into a roll 4, the sheet 2 generally carries a layer 6 of air into the roll 4. See FIG. 1. At low winding speeds, this layer 6 of air can escape at ends of the roll 4 without causing significant deformations in the sheet 2 during winding. At high speeds of, for instance, 400 to 1200 feet per minute, air is wound into the roll 4 unless precautionary measures are taken.

When air is wound up in a roll 4', air acts as a lubricant between layers 8,10 of the material allowing shifting within consecutive layers particularly near the center or core of the roll 4'. This condition is illustrated in FIGS. 2 and 3 and is commonly referred to as roll telescoping.

Further, when air is wound up in a roll 4'', air can become trapped between layers 12,14 of the material. Trapped inside the roll 4'', the air forms tires, balloons or bubbles 16, causing deformation and occupying volume as undesired layers. This is illustrated in FIGS. 4 and 5.

Rider or wind-up lay-on rolls are used to "squeeze out" entrapped air from wide webs that are wound into wind-up rolls at high winding speeds to reduce and control the quantity of air wound between layers.

In the manufacture of photographic film, improper winding can cause costly defects. Several coatings which include a photo-sensitive emulsion, backing and abrasion layers are coated on a polyester base sheet having a thickness on the order of 4–7 mils (or 0.004–0.007 inches) and having a width typically 60 inches or more. The coatings are dried. Then the sheet is wound on 6 to 10 inch diameter cores with controlled tensions to suit product type.

The layers on the sheet are sensitive to pressure and abrasion. Therefore, some air entrapment is desired to maintain tension uniformity throughout the roll and to compensate for gauge thickness variation across the web. Too much air can cause slippage between the layers which results in scratches, telescoping, tires, balloons and static build-up during the wind-up or unwind process. Too little air can result in pressure marks.

It is known to wind-up photographic film on cores rotatably mounted on a fixed support or on rotatable arms of turret assemblies. In the case of cores mounted on a fixed support, film accumulators are positioned between the film making operations and the core. Accumulators allow the film making operations to continue when exchanging a first core with a full roll of film on it with an empty second core by taking up the slack of the continuously manufactured film. Accumulators are not necessary with turret assemblies having automatic roll start capabilities. Conventional turret assemblies of this type typically have two cores which are spaced 180 degrees apart. The cores are rotatable about their longitudinal axes and rotatable about an axis of the turret assembly. When film is sufficiently wound on a first one of the cores, the two cores rotate about the turret axis substituting the empty or second core for the first core with the film on it. The film is cut. Then the film is wound on the second core. While the film is being wound on the second core, the first core is removed and replaced with an empty core. This process continues allowing the associated film-making operations to be continuous through the core replacing process.

Conventional designs of rider rolls or wind-up roll lay-on rolls can be described as off-turret assembly and on-turret assembly. Off-turret assembly rider rolls are rider rolls that are mounted on a support that does not rotate with the cores on the turret assembly. On-turret assembly rider rolls are rider rolls that are mounted on a support that does rotate with the cores on the turret assembly.

It is desirable to provide an apparatus and method for maintaining a constant or uniform force across the width of a film while the film is being wound onto a core.

It is also desirable to provide an apparatus and method for maintaining a constant or uniform force across the width of a film being wound on a core when the core becomes full and is rotated, such as, on a turret assembly and replaced with an empty core.

It is another object of this invention to provide an on-turret apparatus and method for supporting a rider or wind-up lay-on roll such that the rider or wind-up lay-on roll applies a substantially uniform force across the width of a film when the film is wound on a first core and after the first core becomes full, when the full core is rotated, such as, on a turret assembly and replaced with an empty core.

SUMMARY OF THE INVENTION

The present invention relates to an apparatus for supporting ends of a wind-up lay-on roll while the roll applies a substantially uniform contact force across a width of web material being wound into a roll having an axis, the apparatus comprising:

a first linkage assembly and a second linkage assembly, one of the linkage assemblies for connecting each end of the wind-up lay-on roll to a support and adapted to move such that movement of the ends of the wind-up lay-on roll is confined in a substantially radial direction from the web roll axis when the wind-up lay-on roll is in contact with the width of an outer surface of the web roll;

a force sensor for sensing and forming a signal representative of the force being applied to each end of the wind-up lay-on roll;

a position sensor for sensing and forming a signal representative of the angular position of a link or crank in one of the linkage assemblies;

a position sensor for sensing and forming a signal representative of the position of the outer surface of the web roll; and means responsive to the force signals and the position signals for moving the linkage assemblies such that the wind-up lay-on roll applies a substantially uniform force across the width of the web material being wound into the roll.

The present invention is further directed to a method for winding a web or sheet of material into a first roll using a turret assembly having a first web roll core assembly rotatable about a first core axis and a second web roll core assembly rotatable about a second core axis, the first and second web roll core assemblies also rotatable about a turret axis, comprising:

winding a web or sheet of material into a first roll on a first core of the first web roll core assembly;

rotating the first roll of material on the first core assembly and a second empty core of the second web roll core assembly about the turret axis while the web continues to be wound on the first core assembly; and applying a substantially uniform contact force across a width of the web when the web is being wound up into the roll on the first core during the winding and rotating steps.

BRIEF DESCRIPTION OF THE DRAWINGS

The invention can be more fully understood from the following detailed description thereof in connection with accompanying drawings which form a part of this application and in which.

Figure 1:
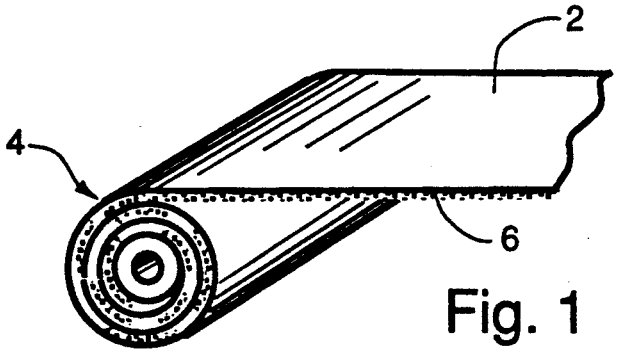
FIG. 1 is a perspective illustration of a sheet or web of material being wound up into a roll with air carried into the roll between layers of the material.
Figure 2:
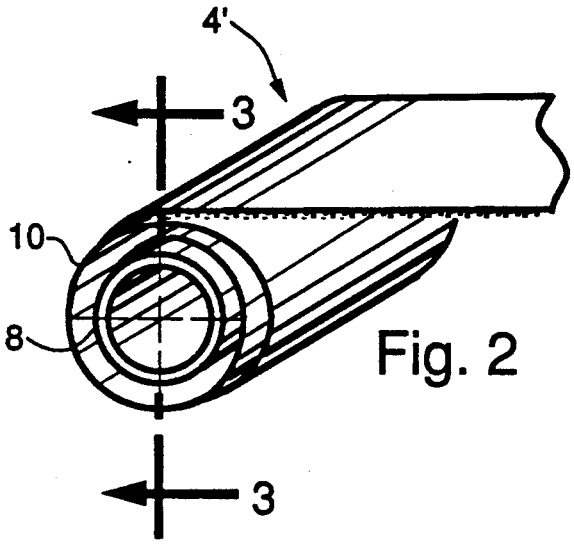
FIG. 2 is a perspective illustration of a sheet or web of material being wound up into a roll with air in the roll allowing shifting between layers in the roll which is referred to as roll telescoping.
Figure 3:
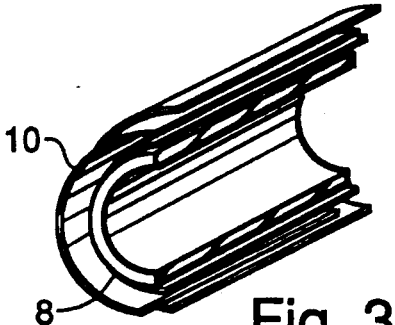
FIG. 3 is a cross sectional view taken along line 3—3 in FIG. 2 in the direction of the arrows.
Figure 4:
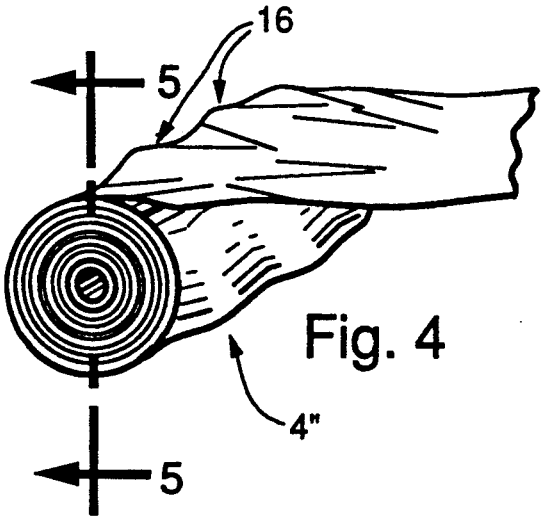
FIG. 4 is an illustration of a sheet or web of material being wound up into a roll with air carried into the roll forming tires, balloons or bubbles.
Figure 5:
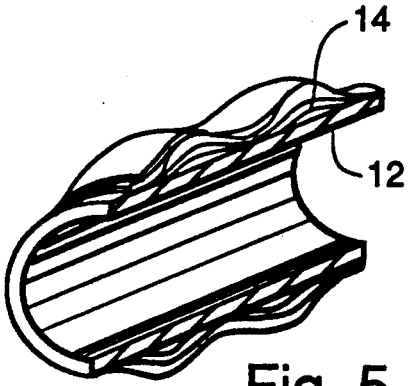
FIG. 5 is a cross sectional view taken along line 5—5 in FIG. 4 in the direction of the arrows.

FIG. **14*a*** is a schematic illustration of a first part of an electrical control system for the present invention.

FIG. **14*b*** is a schematic illustration of a second part of an electrical control system for the present invention.

DESCRIPTION OF THE PREFERRED EMBODIMENT(S)

Throughout the following detailed description, similar reference characters refer to similar elements in all figures of the drawings.

Figure 6:
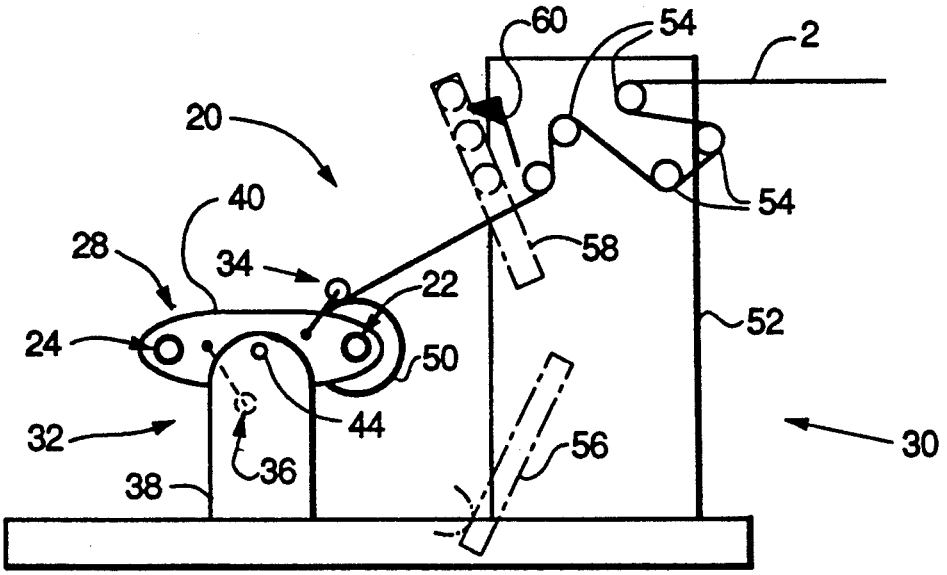
FIG. 6 illustrates a step of winding a web of material into a wind-up roll on a first core on a turret assembly with a first rider or wind-up lay-on roll applying a substantially uniform force across a width of the web.

Referring to FIG. 6, there is schematically illustrated a web winding station 20 for winding up a web or sheet 2 of material into a first roll 22 on a first core of a first web roll core assembly 22 and, when the first core is full, for replacing the first core with a second core of a second web roll core assembly 24 and causing the web 2 to wind-up on the second core. The web winding station 20 generally comprises a web winding machine 28 and an accessory assembly 30.

The web winding machine 28 comprises a turret assembly 32, the first web roll core assembly 22, a first rider or wind-up lay-on roll assembly 34, the second web roll core assembly 24 and a second rider or wind-up lay-on roll assembly 36.

The turret assembly 32 comprises a base 38 and a pair of spaced apart arms 40 rotatably connected about a pivot to the base 38 about a turret arm axis of rotation. A solid or tubular support 44 may connect the arms 40 generally at the pivot. Each of the arms 40 have a first end portion and a second end portion, one of the end portions is on each side of the pivot. Conventional means (not illustrated) are provided for rotating the arms 40 about the arm axis of rotation in a controlled manner.

The first web roll core assembly 22 is mounted between the first end portions of the arms 40. The first web roll core assembly 22 has a core axis of rotation. The first web roll core assembly 22 may comprise spindles or hubs connected to the arms 40 and a core rotatably mounted on the spindles such that the core is adapted to rotate about the core axis and the turret arm axis. The second web roll core assembly 24 can be identical to the first web roll core assembly 22, except the second web roll core assembly 24 is mounted between the second end portions of the arms 40. Conventional means (not illustrated) are provided for rotating the first core about the first core axis of rotation in a controlled manner and for rotating the second core about the second core axis of rotation in a controlled manner.

The first rider or wind-up lay-on roll assembly 34 comprises means for controlling web roll formation by applying a substantially uniform contact force across a width of the web 2 when the web 2 is being wound up into a roll 50 on the first core. The second rider or wind-up lay-on roll assembly 36 comprises means for controlling web roll formation by applying a substantially uniform contact force across a width of the web when the web is being wound up into a roll on the second core.

The accessory assembly 30 generally comprises a support frame 52, idler rolls 54 rotatably mounted to the support frame 52, an enveloper assembly 56 pivotally mounted to the support frame 52, a bumper roll assembly 58 pivotally mounted to the support frame 52, and a knife and air supply assembly 60 extendably (and preferably pivotally) mounted to the support frame 52.

In operation, referring to FIG. 6, a web 2 of material is directed by the idler rolls 54 through the accessory assembly 30 into a wind-up roll 50 on the first core assembly 22 on the turret assembly 32 with the first rider or wind-up lay-on roll assembly 34 applying a substantially uniform force across a width of the web 2.

Figure 7:
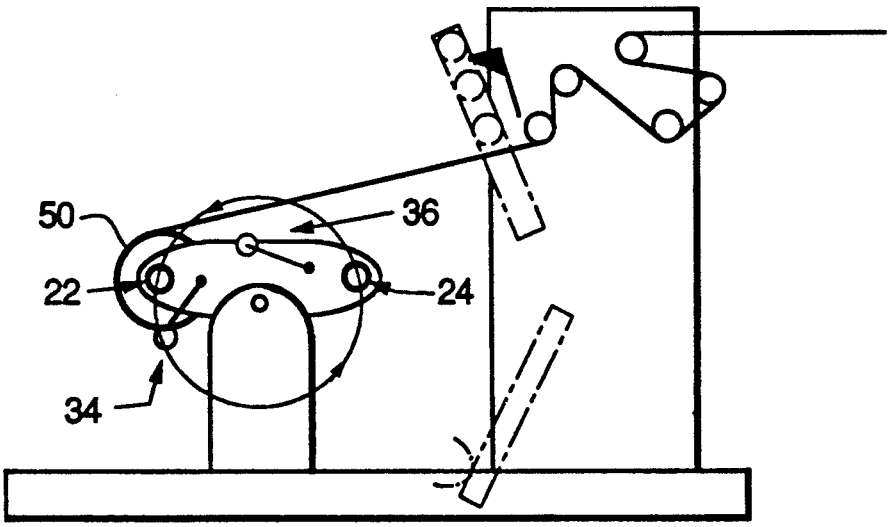
FIG. 7 illustrates steps of rotating the wound-up roll of material on the first core about an axis of the turret assembly and rotating an empty core on the turret assembly about the axis of the turret assembly to replace the first core.

Referring to FIG. 7, when the wound-up roll 50 of material on the first core assembly 22 becomes or approaches a maximum limit or desirable roll diameter, the wound-up roll 50 of material on the first core assembly 22 is rotated about the axis or pivot of the turret assembly 32 while the web 2 continues to be wound on the first core assembly 22. During this rotation of the first core assembly 22 about the turret axis, the first rider or wind-up lay-on roll assembly 34 continues to apply a substantially uniform force across a width of the web 2 as the web 2 continues to be wound-up on the first core assembly 22. At the same time, the second core assembly 24 which has no film on it is rotated about the axis or pivot of the turret assembly 32 to position originally occupied by the first core assembly 22.

Figure 8:
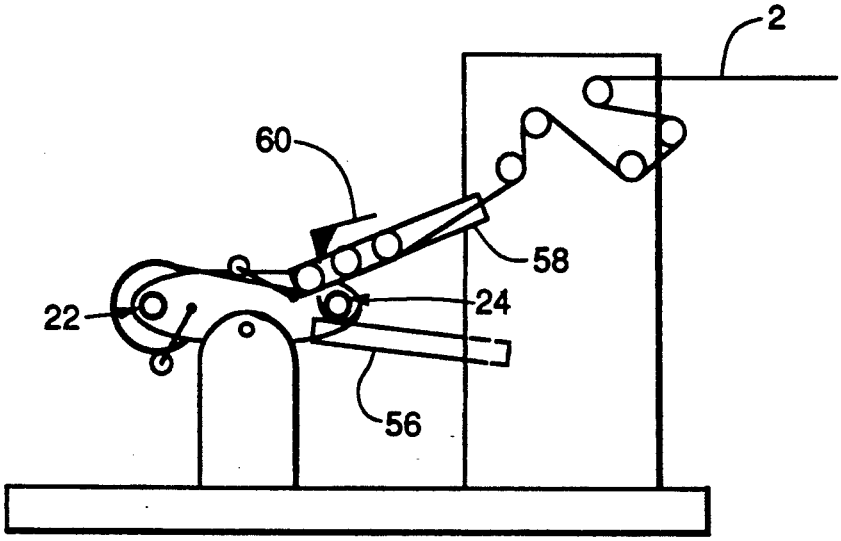
FIG. 8 illustrates steps of pivoting a bumper roll assembly, a knife and air supply assembly and an enveloper into a pre-splice position where the bumper roll assembly is contacting the web of film, the knife and air supply assembly is in position above and across a width of the web of film, and the enveloper is under and partially around the second core forming a film transport channel between the second core and the enveloper.

FIG. 8 illustrates the next steps of pivoting the bumper roll assembly 58, the knife and air supply assembly 60 and the enveloper assembly 56 into a pre-splice position. In the pre-splice position, the bumper roll assembly 58 is contacting the web 2 of film, the knife and air supply assembly 60 is in position above and across a width of the web 2 of film, and the enveloper assembly 56 is under and partially around the second core of the second core assembly 24 forming a film transport channel between the second core and the enveloper assembly 56.

Figure 9:
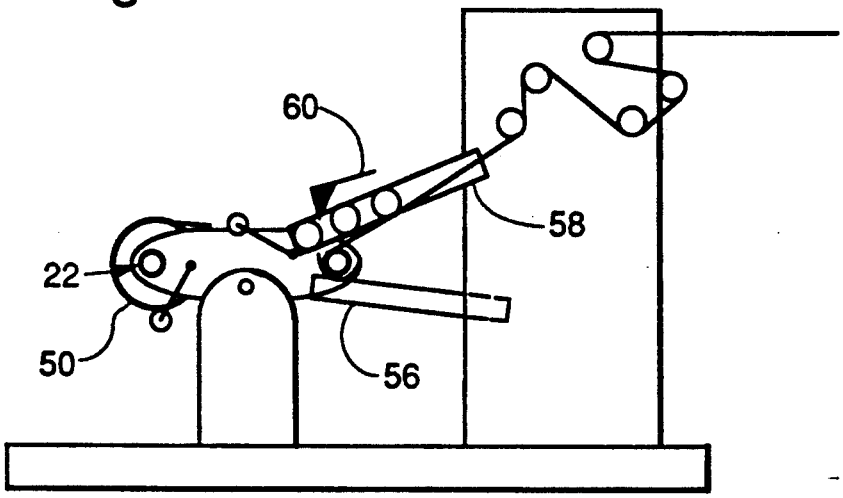
FIG. 9 illustrates the steps of cutting the film with a knife (in the knife and air supply assembly), directing air from an air supply (in the knife and air supply assembly) to direct a new leading edge of the web of material into the channel and rotating the second core to transport the web through the channel initiating a new roll on the second core.

FIG. 9 illustrates the next steps of bringing the web into contact with the rotating second core, cutting the film with a knife (in the knife and air supply assembly 60), directing air from an air supply (in the knife and air supply assembly 60) to direct a new leading edge of the web 2 of material into the channel and rotating the second core to transport the web through the channel initiating a new roll 70 on the second core.

Figure 10:
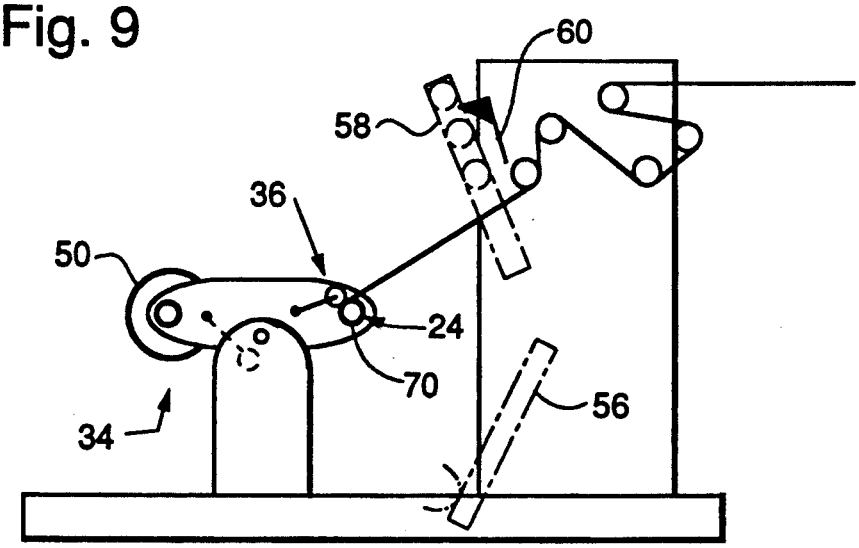
FIG. 10 illustrates the steps of retracting the bumper roll assembly, the knife and air supply assembly and the enveloper, moving a second rider roll into contact with the new roll of web material forming on the second core and moving the first rider roll into a retracted position away from the full roll of web material on the first core allowing removal of the full roll and substitution of an empty third core for the first core.

FIG. 10 illustrates the next steps of retracting the bumper roll assembly 58, the knife and air supply assembly 60 and the enveloper assembly 56, moving the second rider roll assembly 36 into contact with the new roll 70 of web material forming on the second core assembly 24 and moving the first rider roll assembly 22 into a retracted position away from the full roll 50 of web material on the first core allowing removal of the full roll 50 and substitution of an empty third core for the first core.

Figure 11:
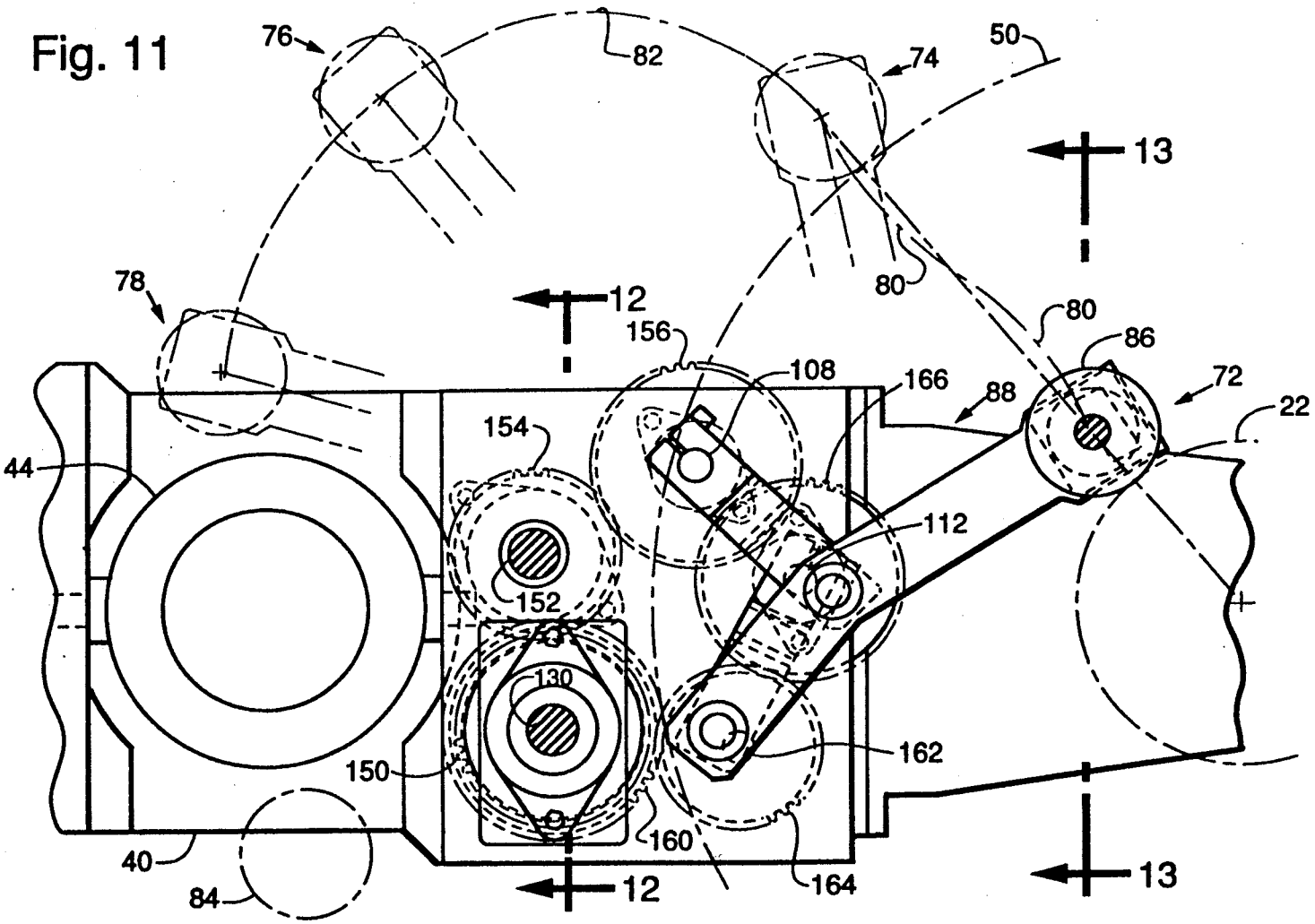
FIG. 11 is a side view of part of an apparatus for supporting an on-turret assembly rider or wind-up lay-on roll which enables the rider roll to apply a substantially uniform force across a width of web material being wound into a roll on a turret assembly in accordance with the present invention.
Figure 12:
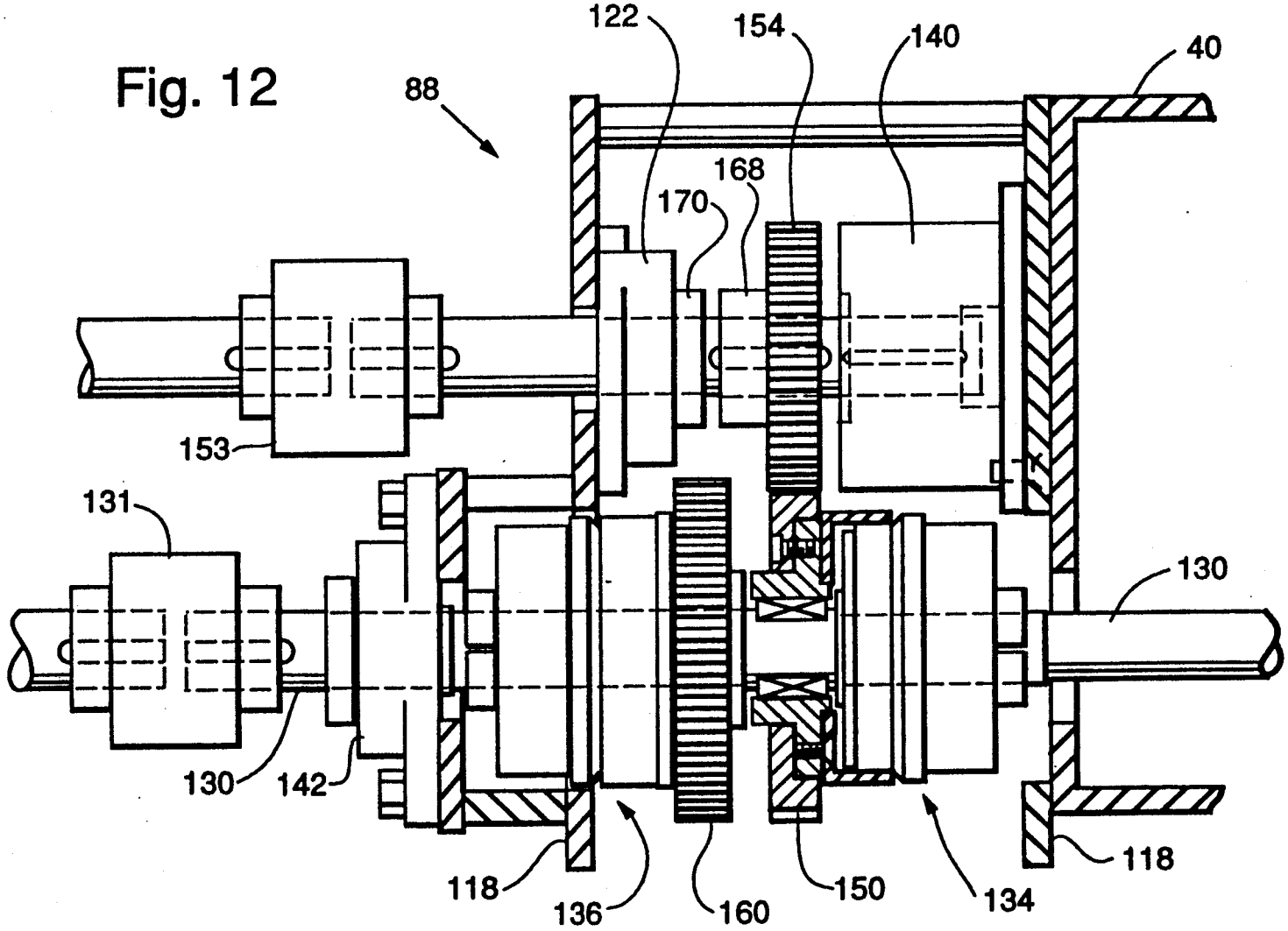
FIG. 12 is a cross sectional view generally taken along line 12—12 in FIG. 11 in the direction of the arrows.
Figure 13:
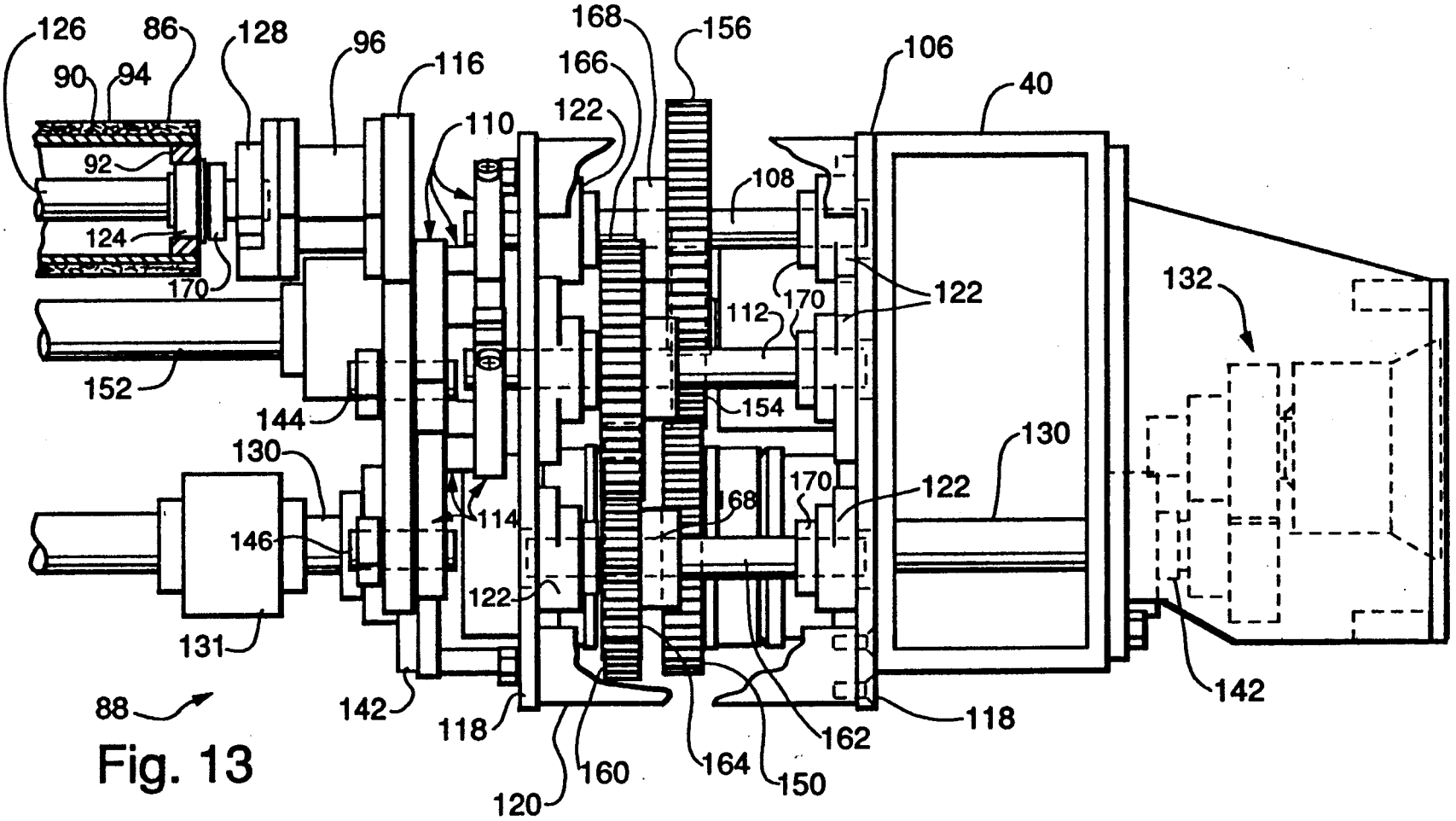
FIG. 13 is a cross sectional view generally taken along line 13—13 in FIG. 11 in the direction of the arrows.

FIG. 11 is an enlarged side view of a preferred embodiment of part of the web winding machine 28 in accordance with the present invention. FIG. 12 is a cross sectional view generally taken along line 12—12 in FIG. 11 in the direction of the arrows. FIG. 13 is a cross sectional view generally taken along line 13—13 in FIG. 11 in the direction of the arrows. FIGS. 12 and 13 show one end of the apparatus for supporting a rider roll 86. A mirror image of the structure illustrated in FIGS. 12 and 13, but for certain parts which would be redundant, supports the other end of the rider roll 86.

FIG. 11 depicts one of the arms 40 of the turret assembly 32, the tubular support 44 for interconnecting the pair of the turret assembly arms 40, and the first rider or wind-up lay-on roll assembly 34. The first rider or wind-up lay-on roll assembly 34 is illustrated in FIG. 11 in a first position 72 in solid lines in contact with the web being wound on the first core of the first core assembly 22. FIG. 11 further illustrates part of the first rider or wind-up lay-on roll assembly 34 in phantom or dashed lines in three other positions 74,76,78. From the position 72 of the first rider or wind-up lay-on roll assembly 34 illustrated in solid lines to a first one 74 of the phantom positions, the first core assembly 22 is adapted to move in a substantially radial direction or path 80 away from the first core axis of rotation as web is wound on the first core. The first position 74 of the first rider or wind-up lay-on roll assembly 34 indicated in phantom is a transition position where the first rider or wind-up lay-on roll assembly 34 stops moving substantially radially away from the first core axis of rotation and then moves in an arc 82 path with respect to the first core axis or the turret assembly arms 40 to a fully retracted position indicated by the third position 78 of the first rider or wind-up lay-on roll assembly 34 in phantom lines. FIG. 11 further illustrates in phantom lines a fully retracted position 84 of the second rider or wind-up lay-on roll assembly 36.

The first rider or wind-up lay-on roll assembly 34 comprises (I) an on-turret assembly first rider or wind-up lay-on roll 86 and (II) a supporting apparatus 88 for supporting the on-turret assembly rider or wind-up lay-on roll 86 which enables the rider roll 86 to apply a substantially uniform force across a width of web material being wound into a roll 50 on the turret assembly 32 in accordance with the present invention. As noted above, the wind-up roll core assembly 22 is rotated by conventional means to wind-up the web 2 on the first core assembly 22. The supporting apparatus 88 further enables the first rider or wind-up lay-on roll 86 to be rotated due to frictional contact with the web 2 which in turn is being transported by the wind-up roll core assembly 22.

(I)—Referring to FIG. 13, the on-turret assembly first rider or wind-up lay-on roll 86 can comprise a metal cylindrical wall 90, a right end wall 92, a left end wall (not depicted) and an elastomeric or rubber coating 94 on an outer surface of the cylindrical wall 90.

(II)—Referring to FIGS. **14*a* and 14*b*, the supporting apparatus 88 comprises (1) a first or right linkage assembly or means 95 connecting the right roll end to a first or right one of the pair of the arms 40; (2) a second or left linkage assembly or means 97 connecting the left roll end to a second or left one of the pair of the arms 40; (3) a force sensor 96 for sensing and forming a signal representative of the force being applied to each end of the wind-up lay-on roll 86; (4) a link position sensor 98 for sensing and forming a signal representative of the position of a link in the linkage assembly; (5) a turret position sensor 100 for sensing and forming a signal representative of the angular position of an arm 40 of the turret assembly 32; (6) a roll position sensor 102 for sensing and forming a signal representative of the position of the outer surface of the web roll 50; and (7). means 104 responsive to the force signals and the position signals for moving the linkage assemblies 95,97 such that the wind-up lay-on roll 86 applies a substantially uniform pressure or force across the width of the web material being wound into the roll 50**.

(1,2)—More specifically, each one of the right linkage assembly 95 and the left linkage assembly 97 comprises means for connecting each end of the first wind-up lay-on roll 86 between the pair of arms 40 of the turret assembly 32. Each one of the linkage assemblies 95,97 is further adapted to move the first wind-up lay-on roll 86 such that movement of the ends of the first wind-up lay-on roll 86 is confined in a substantially radial direction from the first web roll axis when the first wind-up lay-on roll is in contact with the width of an outer surface of the web roll 50.

Referring to FIG. 13, each one of the linkage assemblies 95,97 comprises a first stationary support 106, a first rotatable shaft 108, a first crank 110, a second rotatable shaft 112, a second crank 114, and a link 116. The first stationary support 106 can be a housing which is connected, such as, by nut and bolt assemblies (not depicted), to one of the arms 40. The housing 106 may have spaced apart support walls or plates 118 with spacer bars 120 interconnecting the spaced apart support walls or plates 118. Portions of the housing 106 are broken away in FIGS. 11–13 for clarity of understanding. The first rotatable shaft 108 can be rotatably supported in bearing assemblies 122 connected to the spaced apart support walls 118. The first crank 110 has a first end and a second end. The first crank first end is connected to an end of the first shaft 108 extending out of the housing 106. The second shaft 112 can be rotatably supported in bearing assemblies 122 connected to the spaced apart support walls 118. The second crank 114 has a first end and a second end. The second crank first end is connected to an end of the second shaft 112 extending out of the housing 106. The first and second cranks 110,114 preferably have a "Z" or stepped shape. The link 116 has a first end, a middle portion and a second end. The link first end is rotatably connected to one end of the first wind-up lay-on roll 86. The link middle portion is rotatably connected by a pin assembly 144 to the first crank second end. The link second end is rotatably connected by a pin assembly 146 to the second crank second end. Thus, when the wind-up lay-on roll 86 is rotatably connected to the link first ends, the wind-up lay-on roll 86 moves in the substantially radial direction when the first shaft 108 and the second shaft 112 rotate through a predetermined angular range. When the first shaft 108 and the second shaft 112 rotate beyond the predetermined angular range, the wind-up lay-on roll 86 moves away from the web roll 50 deviating from the radial direction to the retracted position 78.

(3)—The force sensors 96 are biaxial sensors for sensing and forming a signal representative of the force being applied to each end of the wind-up lay-on roll 86. Each one of the biaxial force sensors 96 is adapted to sense force in two perpendicular directions, both directions perpendicular to the axis of rotation of the wind-up lay-on roll 86. Suitable force sensors 96 that can be used in the present invention are called AMTI Transducer Series SRM C3-2-500 Fx and Fy sensing load cells commercially available from Advanced Mechanical Technology, Inc., of Newton, Mass. One of the force sensors 96 is mounted to each one of the first ends of the link 116. Bearing assemblies 124 can be secured in the end walls 92 of the first wind-up lay-on roll 86. A rider roll shaft 126 can extend through the bearing assemblies 124 supporting the rider roll 86. Ends of the rider roll shaft 126 can be supported in bearing assemblies 128 connected to the biaxial force sensors 96.

(4)—The link position sensor 98 is for sensing and forming a signal representative of the angular position of one of the cranks 110,114 in one of the linkage assemblies 95,97. The link position sensor 98 can be an encoder assembly mounted to one of the shafts connected to one of the cranks 110,114.

(5)—The turret position sensor 100 is for sensing and forming a signal representative of the angular position of one of the arms 40 of the turret assembly 32. The turret position sensor 100 can comprise an encoder assembly mounted on the turret arm 40 or support 38.

(6)—The roll position sensor 102 is for sensing and forming a signal representative of the position of the outer surface of the web roll 50 with respect to the position of the sensor 102. The roll position sensor 102 can be an ultrasonic sensor mounted to turret assembly support 44.

(7)—The moving means 104 comprises means for rotating either the first rotatable shaft 108 or the second rotatable shaft 112; and a control system for processing the force signals and the position signals and for controlling the rotating means such that the torque applied to either the first shaft 108 or the second shaft 112 causes the wind-up lay-on roll 86 to apply a substantially uniform force across the width of the web material being wound into the roll 50.

Referring to FIGS. 12 and 13, (*7a*) the rotating means comprises a rotatable motor assembly or drive shaft 130; an adjustable motor assembly 132 connected to rotate the rotatable motor assembly or drive shaft 130; a first clutch assembly 134 and a second clutch assembly 136 connected to the motor assembly or drive shaft 130; and first shaft rotating means connected between the first clutch assembly 134 and the first rotatable shaft 108 for rotating the first rotatable shaft 108 when the motor assembly or drive shaft 130 rotates and the first clutch assembly 134 is engaged; and second shaft rotating means connected between the second clutch assembly 136 and the second rotatable shaft 112 for rotating the second rotatable shaft 112 when the motor assembly or drive shaft 130 rotates and the second clutch assembly 136 is engaged. There can also be a brake assembly 140 for slowing down, stopping or preventing the rotation of the first and second shafts 108,112.

The rotatable motor assembly or drive shaft 130 can be supported in bearing assemblies 142 connected to the spaced apart support walls 118, a support wall 119 connected to and extended from one of the spaced apart support walls 118, and/or the turret assembly arm 40. The rotatable motor assembly or drive shaft 130 preferably extends between the housings 106 connected to each one of the pair of turret arms 40. This enables both of the linkage assemblies 95,97 to be moved by the single drive shaft 130. Further, couplers 131 can interconnect shaft portions to extend the drive shaft 130 between the housings 106. The adjustable motor assembly 132 can comprise a DC reversible motor adapted to rotate a motor shaft (not depicted), a gear box having gears (not depicted) interconnecting the motor shaft with a gear box shaft and adapted to change, e.g., reduce, the rotational speed of the gear box shaft with respect to the motor shaft, an output gear on the gear box shaft, and an input gear engaged with the output gear and on the motor assembly or drive shaft 130.

The first shaft rotating means comprises a first gear 150, a third rotatable shaft 152, a second gear 154, and a third gear 156. The first gear 150 is connected to the first clutch assembly 134 such that when the first clutch assembly 134 is engaged the first gear 150 rotates with the motor assembly or drive shaft 130 and when the first clutch assembly 134 is disengaged the first gear 150 does not rotate with the motor assembly or drive shaft 130. The third rotatable shaft 152 can be rotatably supported in bearing assemblies 122 connected to the spaced apart support walls 118. The second gear 154 is fixed to the third rotatable shaft 152. The second gear 154 engages and is rotatable by the first gear 150. The third gear 156 is fixed to the first rotatable shaft 108. The third gear 156 engages and is rotatable by the second gear 154. The third rotatable shaft 152 preferably extends between the housings 106 connected to each one of the pair of turret arms 40. This enables one of the brake assemblies 140 to be on either end of the same shaft 152 and both of the second gears 154 to be fixed on the same shaft 152. Further, couplers 153 can interconnect shaft portions to extend the third rotatable shaft 152 between the housings 106.

The second shaft rotating means comprises a fourth gear 160, a fourth rotatable shaft 162, a fifth gear 164, and a sixth gear 166. The fourth gear 160 is connected to the second clutch assembly 136 such that when the second clutch assembly 136 is engaged the fourth gear 160 rotates with the motor assembly or drive shaft 130 and when the second clutch assembly 136 is disengaged the fourth gear 160 does not rotate with the motor assembly or drive shaft 130. The fourth rotatable shaft 162 can be rotatably supported in bearing assemblies 122 connected to the spaced apart support walls 118. The fifth gear 164 is fixed to the fourth rotatable shaft 162. The fifth gear 164 engages and is rotatable by the fourth gear 160. The sixth gear 166 is fixed to the second rotatable shaft 112. The sixth gear 166 engages and is rotatable by the fifth gear 164.

The gears may include hubs 168. The bearing assemblies may include collars 170 which lock or clamp onto the shafts preventing axial movement of the shafts with respect to the bearing assemblies.

Referring to FIG. 12, the brake 140 can be connected to one of the spaced apart side walls 118 or one of the arms 40. The brake 140 receives an end of the third rotatable shaft 152 and is adapted to slow down, stop or prevent the rotation of the third rotatable shaft 152.

(7b)—The control system provides the motor assembly 132 an electrical signal to turn either clockwise or counterclockwise at some speed or torque. The control system further gives a command to the clutch assemblies 134,136 to engage or disengage. Only one clutch assembly is engaged at a time. The brake assembly 140 is activated during a transition where one of the clutch assemblies is being engaged and the other is being disengaged. The brake assembly 140 can also be applied when no power is being applied to the web winding machine 28. The control system controls the clutch assemblies 134, 136 and the brake assembly 140 such that torque is applied by the second rotatable shaft 112 when the rider roll 86 is in contact with the web 2 as illustrated in position 72 in FIG. 11 and so long as the path of the rider roll 86 is substantially radial from the web roll axis of rotation, i.e., until the rider roll 86 reaches the position illustrated at 74 in FIG. 11. The position 74 is the transition position where the brake is momentarily applied and one clutch assembly engages and the other one disengages depending on whether the rider roll 86 is approaching or retracting from the web roll. Between the positions 74 and 78 illustrated in FIG. 11, the torque is applied by the first rotatable shaft 108.

Figure 14A:
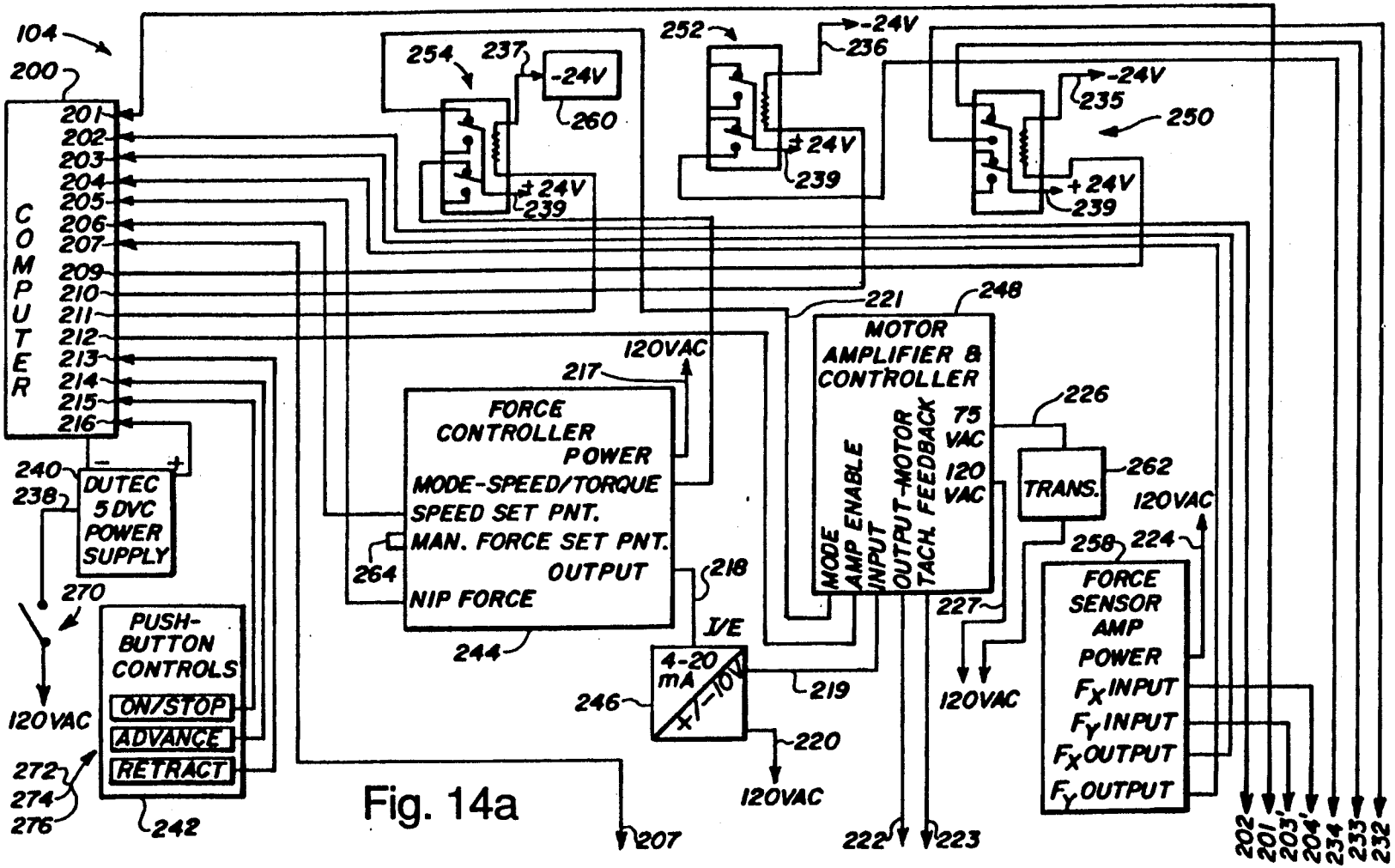
Figure 14B:
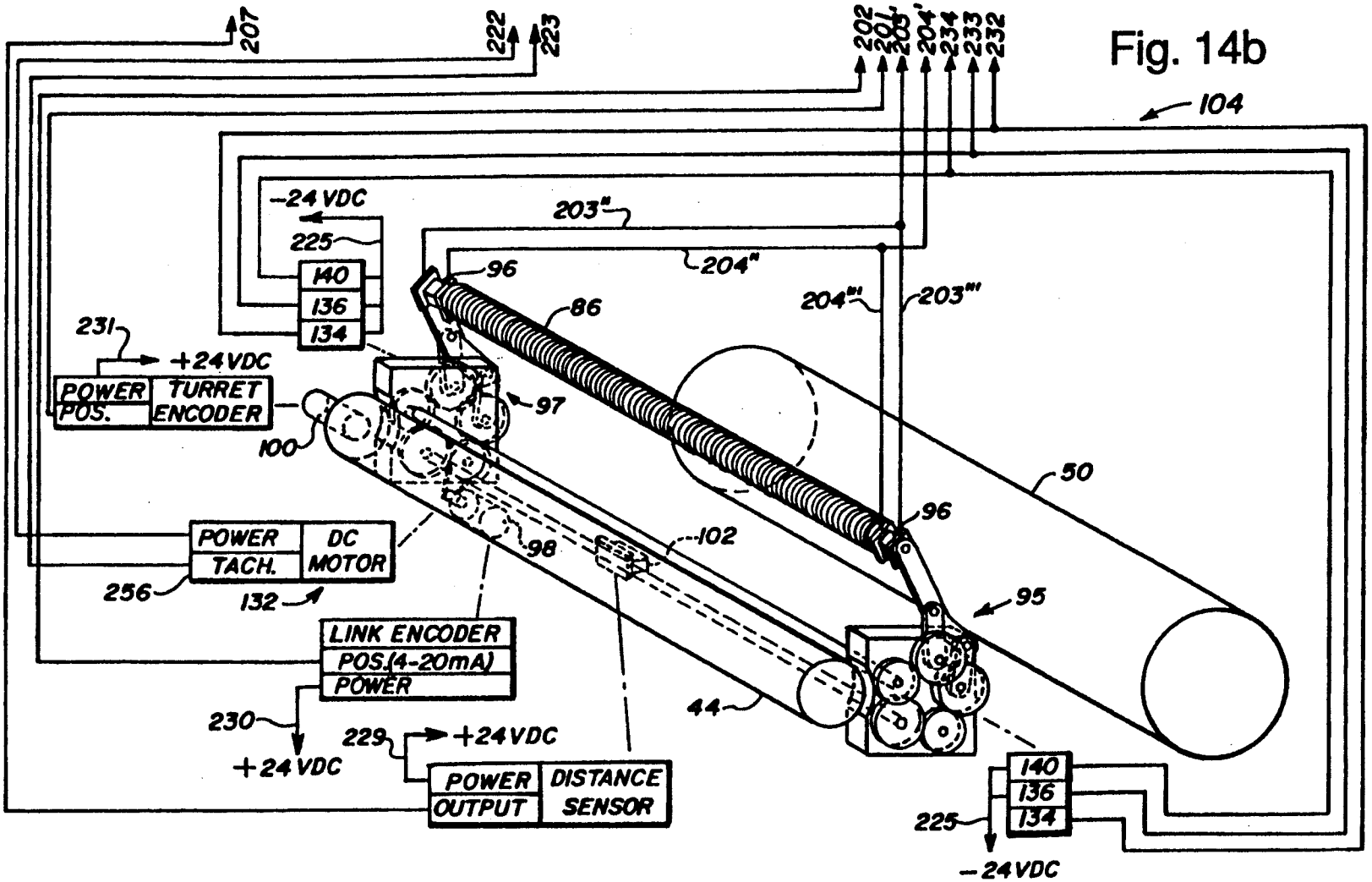

Referring to FIGS. 14*a* and 14*b*, the control system comprises means connected to receive signals from the sensors 96,98,100,102 for processing the signals and calculating the actual contact or nip force between the web roll and the lay-on roll 86; and means for comparing the actual contact force to a preset force and for sending control signals to the rotating means to move the lay-on roll 86 with respect to the web roll or to maintain the contact force between the web roll and the lay-on roll 86 substantially constant. The control system is connected to control the motor assembly 132, the first and second clutch assemblies 134,136 and the brake 140 such that (1) the control signals control torque applied by the motor assembly 132 on the motor assembly shaft 130, (2) when the motor assembly 132 applies a torque on the motor assembly shaft 130 and the first clutch assembly 134 is engaged, the first shaft 108 applies a torque on the first crank 110, the link 116, and the second crank 114 to move or sustain a force on the wind-up lay-on roll 86, and (3) when the motor assembly 132 applies a torque on the motor assembly shaft 130 and the second clutch assembly 136 is engaged, the second shaft 112 applies a torque on the second crank 114, the link 116, and the first crank 110 to move or sustain a force on the wind-up lay-on roll 86.

The control system preferably comprises a computer 200, lines 201–238, a first low voltage DC power supply 240, a control pad 242, a nip force controller 244, an amperage to voltage conversion device 246, a motor amplifier and controller 248, a first or second clutch relay 250, a brake engage or disengage relay 252, a speed or torque mode relay 254, a motor tachometer 256, a force transmitter 258, a second low voltage DC power supply 260 and an AC voltage transformer 262.

A suitable computer 200 that can be used in the present invention is called a Dutec S65A-16P-2S stack -65 control computer commercially available from Dutec Inc., of Jackson, Mich. A suitable nip force controller 244 that can be used in the present invention is called a Moore 352 process controller commercially available from Moore Products of Union, N.J. A suitable motor amplifier and controller 248 that can be used in the present invention is called a Infranor amplifier/controller no. 100/13/26 with an infrared card for changing from voltage loop to current loop via an external switching device commercially available from Infranor Inc. of Naugatuck, Conn.

Line 201 connects an input of the computer 200 to the turret encoder assembly 100. Line 202 connects an input of the computer 200 with the crank or link encoder assembly 98. Line 203 connects an input of the computer 200 with an X component of the nip force output of the force transmitter 258. Lines 203', 203'' and 203''' connect the biaxial force sensors in parallel to an X component of the nip force input of the force transmitter 258. Line 204 connects an input or the computer 200 with a Y component of the nip force output of the force transmitter 258. Lines 204', 204'' and 204''' connect the biaxial force sensors in parallel to a Y component of the nip force input of the force transmitter 258. Line 205 connects an output of the computer 200 with a nip force input of the nip force controller 244. Line 206 connects an output of the computer 200 with a speed set point input of the nip force controller 244. Line 207 connects an input of the computer 200 with the web roll position sensor 102. Line 209 connects an output of the computer 200 with a coil portion input of the first or second clutch relay 250. Line 210 connects an output of the computer 200 with a coil portion input of the brake engage or disengage relay 252. Line 211 connects an output of the computer 200 with a coil portion input of the speed or torque mode relay 254. Line 212 connects an output of the computer 200 with an amplifier enable or disable input of the motor amplifier and controller 248. Line 213 connects an input of the computer 200 with a stop push button switch 272 on the control pad 242. Line 214 connects an input of the computer 200 with a rider roll advance push button switch 274 on the control pad 242. Line 215 connects an input of the computer 200 with a rider roll retract push button switch 276 on the control pad 242. Line 216 connects the computer 200 with the DC power supply 240. Line 217 is adapted to connect a power input to the nip force controller 244 to a 120 Volt AC power supply. Line 218 connects an output of the nip force controller 244 to an input of the conversion device 246. Line 219 connects an output of the conversion device 246 to an input of the motor amplifier and controller 248. Line 220 is adapted to connect a power input to the conversion device 246 to a 120 Volt AC power supply. Line 208 connects a contact portion of the speed or torque mode relay 254 with an input to the nip force controller 244. Line 221 connects a contact portion of the speed or torque mode relay 254 with an input to the motor amplifier and controller 248. Line 222 connects an output of the motor amplifier and controller 248 to a power input to the motor assembly 132. Line 223 connects an output of the motor tachometer 256 with a feedback input to the motor amplifier and controller 248. Line 224 is adapted to connect a power input to the force transmitter 258 to a 120 Volt AC power supply. Lines 225 are adapted to connect power inputs to the left and right brake assemblies and first and second clutch assemblies to the second low volt DC power supply 260. Line 226 connects a power input of the motor amplifier and controller 248 with a power output of the AC voltage transformer 262. Line 227 is adapted to connect a power input to the motor amplifier and controller 248 to a 120 Volt AC power supply. Line 228 is adapted to connect a power input to the AC voltage transformer 262 to a 120 Volt AC power supply. Line 229 is adapted to connect a power input to the web roll position sensor 102 to the second low volt DC power supply 260. Line 230 is adapted to connect a power input to the crank or link position sensor 98 to the second low volt DC power supply 260. Line 231 is adapted to connect a power input to the turret arm position sensor 100 to the second low volt DC power supply 260. Line 232 connects a contact portion of the first or second clutch relay 250 in parallel with the right and left first clutch assemblies 134. Line 233 connects a contact portion of the first or second clutch relay 250 in parallel with the right and left second clutch assemblies 136. Line 234 connects a contact portion of the brake engage or disengage relay 252 in parallel with the right and left brake assemblies 140. Line 235 is adapted to connect the coil portion of the first or second clutch relay 250 with the second low volt DC power supply 260. Line 236 is adapted to connect the coil portion of the brake engage or disengage relay 252 with the second low volt DC power supply 260. Line 237 is adapted to connect the coil portion of the speed or torque mode relay 254 with the second low volt DC power supply 260. Line 238 is adapted to connect a power input to the first low voltage DC power supply 240 to a 120 Volt AC power supply. Lines 239 are adapted to connect the contact portions of the relays 250,252,254 with the second low volt DC power supply 260.

In operation, the control system operates in two modes, i.e., the velocity or speed control mode and the nip force control mode. In the velocity or speed control mode, the rider roll 86 is either advancing towards or retracting from the web 2. In the nip force control mode, the rider roll 86 is in contact with and applying a force on the web 2.

In the velocity or speed control mode, the nip force is zero. As long as the signal over lines 203 and 204 indicate zero nip force, the computer does not send a signal through line 211 to activate or energize the speed or torque relay 250. As long as the speed or torque relay 250 is not activated, a signal (or no signal) is sent by the speed or torque relay 250 (1) over line 221 to the motor amplifier and controller 248 indicating that the motor amplifier and controller 248 should operate in the velocity or speed control mode and (2) over line 208 to the nip force controller 244 indicating that the nip force controller 248 should operate in the velocity or speed control mode. Further, as long as the signal over lines 203 and 204 indicate zero nip force, the computer sends a preprogrammed desired speed signal over line 206 to the nip force controller 244 which passes the desired speed signal straight through the nip force controller 244 onto line 218 without any change to it. The output of the nip force controller 244 on line 218 is converted from a milliamp signal to a plus or minus Volts signal, the sign indicating direction, by the conversion device 246. The motor amplifier and controller 248 receives the desired speed signal over line 219 and compares it to the signal it receives over line 223 from the motor tachometer 256 indicative of the actual velocity of the drive shaft 130 of the motor assembly 132. Then the motor amplifier and controller 248 adjusts its power output over line 222 to the motor assembly 132 to increase or decrease the motor speed to conform it with the desired speed. Throughout this time, the computer 200 also receives signals from the turret encoder 100, the link encoder 98 and the web roll position sensor 102. Based on these signals, the computer 200 calculates the distance between the rider roll 86 and the web roll and compares it to a preset distance. When the calculated distance equals the preset distance, the computer 200 changes its velocity set point signal over line 206 reducing the speed of the rider roll 86.

As soon as the computer receives a signal from the force transmitter 258 and, thus, the biaxial force sensors 96 indicating that the rider roll 86 is contacting the web, i.e., that the nip force is not zero, the computer 200 sends a signal over line 211 to energize the speed or torque relay 250 which opens (or closes) its contact portion (1) stopping (or initiating) its signal over line 221 to the motor amplifier and controller 248 and (2) stopping (or initiating) its signal over line 208 to the nip force controller 244. This switches the motor amplifier and controller 248 and the nip force controller 244 to operate in the nip force control mode. At the same time, as soon as the computer receives a signal from the force transmitter 258 and, thus, the biaxial force sensors 96 indicating that the rider roll 86 is contacting the web, i.e., that the nip force is not zero, based on the signals received over lines 203 and 204 from the force transmitter 258 and the biaxial force sensors 96, the computer 200 calculates and provides over line 205 to the nip force controller 244 a signal representative of the actual nip force between the rider roll 86 and the web 2. The force transmitter 258 amplifies and converts the signals received from the force sensors 96 to signals useable by the computer 200. The computer 200 also uses the signals received over line 207 from the web roll position sensor 102, line 201 from the turret encoder 100 and line 202 from the link encoder 98 to calculate the actual nip force. The nip force controller 244 has a manual nip force set point control 264 for setting a desired nip force between the rider roll 86 and the web 2. The nip force controller 244 compares the calculated actual nip force to the desired nip force and changes its output on line 218 to cause the force applied at the nip to conform to the desired nip force. The output of the nip force controller 244 on line 218 is converted from a milliamp signal to a Volts signal by the conversion device 246. The motor amplifier and controller 248 receives the nip force signal over line 219. Since the motor amplifier and controller 248 is in the force control mode, it determines what current should be supplied to the motor windings to increase or decrease the nip force to conform to the force signal from line 219. Then the motor amplifier and controller 248 compares the desired current to be supplied to the current being supplied through the motor windings which happens to be the current through line 222 or line 223. Then the motor amplifier and controller 248 adjusts the power or current supplied over line 222 or line 223 to control the motor torque to conform to the force signal received over line 219.

In its nonactivated state, the first clutch or second clutch relay 252 sends power over line 233 to the second clutch assembly 136 and the first clutch assembly 134 is deenergized. When the computer 200 sends a signal over line 209 to the first clutch or second clutch relay 252, the signal energizes the coil portion of the first clutch or second clutch relay 252 switching the position of its contacts such that the second clutch assembly 136 is deenergized and power is sent to the first clutch assembly over line 232. Based on signals received from the link encoder 98, the computer 200 either sends signals or does not send signals over line 209 such that torque is applied through the first shaft 108 when the rider roll 86 is between the transition position 74 and the fully retracted position 78 and such that torque is applied through the second shaft 112 when the rider roll 86 is between the transition position 74 and the fully advanced position contacting the core of the core assembly 22.

In its nonactivated state, the brake engage or disengage relay 254 does provide power over line 234 to apply the brake assemblies 140. When the computer 200 sends a signal over line 210 to energize the coil portion of the brake engage or disengage relay 254, the contact portion or the relay 254 switches to release the brake assemblies 140. Also based on signals received from the link encoder 98, the computer 200 either sends signals or does not send signals over line 209 such that the brake assemblies receive power when neither one of the clutch assemblies 134,136 are engaged.

An illustrative software embodiment for use by the present invention is included in an Appendix A to this specification. The software program is written in the Basic language for a Dutec Computer S65A-16P-2S Stack-65 and is appended to this specification following the Detailed Description of the Invention and preceding the claims.

Those skilled in the art, having the benefit of the teachings of the present invention as hereinabove set forth, can effect numerous modifications thereto. These modifications are to be construed as being encompassed within the scope of the present invention as set forth in the appended claims.

APPENDIX A

```
*****************************************************************

Subject: Rider Roll Software for DUTEC computer

Proprietary Notice: This software is the property of E. I. du Pont de
Nemours and Co. with offices at Wilmington, Delaware. The program source ,
listing, binary and executable files are proprietary and may not be
distributed or copied for non-Du Pont use without the express written
approval of Du Pont.

Copyright Notice: Copyright 1990 E. I. du Pont de Nemours and Co.

*****************************************************************

 0 REM LV%,I,AN;LINK VELOCITY - RPM
 1 REM TE%,I,AN;TURRET POSITION ENCODER
 2 REM LE%,I,AN;LINK POSITION ENCODER
 3 REM FX%,I,AN;X-FORCE
 4 REM FY%,I,AN;Y-FORCE
 5 REM NF%,O,AN;NIP FORCE SIGNAL (PROCESS)
 6 REM VS%,O,AN;SPEED SETPOINT
 7 REM UD%,I,AN;ULTRASONIC DISTANCE SENSOR
 9 REM CL%,O,NO,DG;CLUTCH A OR C - NORMALLY CLUTCH C ENGAGED
```

```
10 REM B%,O,NO,DG;BRAKE - NORMALLY ENGAGED
11 REM M%,O,NO,DG;MODE CONTROL - SPEED NORMALLY/FORCE
12 REM AM%,O,NO,DG;MOTOR AMP ENABLE - NORMALLY DISABLED
13 REM R%,I,NO,DG,XGS2#14200;RETRACT PUSHBUTTON
14 REM A%,I,NO,DG,XGS3#14400;ADVANCE PUSHBUTTON
15 REM ST%,I,NO,DG,XGS1#14000/E;STOP PUSHBUTTON
4003 REM
4004 REM LINES 13-15 CONTAIN INTERRUPT SUBROUTINE CALLS
4005 REM
4006 REM
4009 REM                          MODULE TABLE
4012 REM
4013 REM    LOC     COND     MODULE       FUNCTION         TYPE     VA
4014 REM
4015 REM    0       RPM       II420       LINK VELOCITY    A/I      LV
4020 REM    1                 II420       TURRET POS.      A/I      TE
4025 REM    2                 II420       LINK POSITION    A/I      LE
4030 REM    3                 IV10B       X-FORCE          A/I      FX
4035 REM    4                 IV10B       Y-FORCE          A/I      FY
4040 REM    5                 OI420       FORCE SIGNAL     A/O      NF
4045 REM    6                 OI420       SPEED SETPNT     A/O      VS
4050 REM    7                 IV5         DISTANCE SENS.   A/I      UD
4055 REM    8                             SPARE
4060 REM    9       N/O=C=0   ODC5        CLUTCH "A","C"   D/O      CL
4065 REM    10      N/O       ODC5        BRAKE            D/O      B%
4070 REM    11      N/O=S=0   ODC5        MODE CONTROL     D/O      M%
4075 REM    12      N/O       ODC5        MOTOR AMP ENA    D/O      AM
4080 REM    13      N/O       T105        RETRACT          D/I      R%
4085 REM    14      N/O       T105        ADVANCE          D/I      A%
4090 REM    15      N/O       T105        STOP             D/I      ST
4095 REM
4100 REM
4105 REM
4110 REM                       MISCELLANEOUS NOTES
4115 REM
4120 REM
4125 REM   THETA 8 (S8 BELOW) RELATES TO THE ANGULAR POSITION OF LINK CD
4130 REM   WHOSE ORIGIN IS AT C.  THETA 8 = 0 DESCRIBES LINK CD EXTENDED
4135 REM   IN THE +X DIRECTION WHEN VIEWED FROM SIDE A.  THETA 8 = 90
4140 REM   DESCRIBES LINK CD EXTENDED IN THE +Y DIRECTION (VERTICAL)
4145 REM
4150 REM   FOR MECHANICAL ADVANTAGE, CLUTCH "A" USED FOR MOVING WHEN ROLL
4155 REM   LIES BETWEEN THE VIA POINT AND THE FULL RETRACT POSITION...
4160 REM   CLUTCH IS USED FOR MOVING WHEN ROLL LIES BETWEEN VIA AND ROLL
4165 REM   SURFACE
4170 REM
4175 REM   AMTI SRMC3-500 LOAD CELLS HAVE A RESULTANT RATING OF 250# IN
4180 REM   THE X & Y DIRECTIONS AND 500# IN THE Z-DIRECTION (WE ONLY
4185 REM   USE X & Y) LOAD CELL SETTINGS AS SHIPPED ARE.....
4192 REM   SENSITIVITY=3X10^-6 V/#
4195 REM    ................332.33#=10V
4210 REM
4224 REM                          FUNCTION TABLE
4226 REM
4228 REM
4232 REM  VARIABLE                FUNCTION
4235 REM
4238 REM   LV% : 4MA=0 RPM =0 COUNTS......20MA=1000RPM=4095 COUNTS
4241 REM   TE% : 4MA=0 DEG.=0 COUNTS...20MA=359.99 DEG.=4095 COUNTS
4242 REM       : 0 DEG. OPPOSITE LOAD/UNLOAD SIDE WHEN TURRET IS HORIZ.
4244 REM   LE% : 4MA=0 DEG.=0 COUNTS...20MA=359.99 DEG.=4095 COUNTS
4245 REM       : 0 DEG. AT HORIZONTAL, LINK CD POINTS AT TURRET CENTER
4247 REM   FX% : 0 COUNTS=-10V=-345.6 LBS.....4095 COUNTS=+10V=+345.6
4248 REM         AS CALIBRATED 1/90
4250 REM   FY%     COUNTS=-10V=-267.9 LBS.....4095 COUNTS=+10V=+267.9
4251 REM       : AS CALIBRATED 1/90
4253 REM   NF% : 0 COUNTS=0 LBS=4MA.....4095 COUNTS=SQR(345.6^2+267.9
4254 REM       : =437.3 LBS
```

```
4255 REM        :
4256 REM   VS%  : 0 COUNTS=-40RPM.....2047 COUNTS=0RPM
4259 REM        : 4095 COUNTS=40RPM.......+CW,-CCW...AS VIEWED FROM
4260 REM          MOTOR REAR
4261 REM   UD%  : 0 COUNTS= 0 VOLTS=0MM...2097 COUNTS=1000MM...
4262 REM        4095 COUNTS=5 VOLTS=1953MM
4263 REM        0MM=0IN...1953MM=77IN....MM CONVERTED TO IN WITHIN
4264 REM        PROGRAM MEASURED FROM TOP SURFACE OF PARABOLA TO SURFACE
4265 REM   CL%  : 1=CLUTCH "C" DISENGAGED, CLUTCH "A" ENGAGED
4268 REM        : 0=CLUTCH "A" DISENGAGED, CLUTCH "C" ENGAGED
4271 REM   B%   : 0=BRAKE ENGAGED......1=BRAKE DISENGAGED
4274 REM   M%   : 0=SPEED MODE.........1=TORQUE MODE
4277 REM   AM%  : 0=AMPLIFIER DISABLED....1=AMPLIFIER ENABLED
4280 REM   R%   : PUSHBUTTON FOR RETRACTING...WHEN PRESSED RETRACT
4283 REM        : COMMENCES
4286 REM   A%   : PUSHBUTTON FOR INDEXING...WHEN PRESSED INDEX/ADVANCE
4289 REM        : COMMENCES
4292 REM   ST%  : PUSHBUTTON FOR STOPPING...WHEN PRESSED RIDER ROLL
4294 REM        : MOTION STOPS
4296 REM
4297 REM
4298 REM
4300 REM                          VARIABLE TABLE
4301 REM
4302 REM
4305 REM
4310 REM  AD = LENGTH OF LINE AD (INCHES)
4331 REM   D1= EQUIVALENT POUNDS (X-AXIS) AT AMPLIFIED LOAD CELL OUTPUT
4332 REM   D2= EQUIVALENT POUNDS (Y-AXIS) AT AMPLIFIED LOAD CELL OUTPUT
4335 REM   D = DIRECTION CONSTANT....+1 = ADVANCE (INDEX), -1 = RETRACT
4337 REM  DL = MOVE DISTANCE (RAD)
4338 REM  DM = DIRECTION AND LOCATION FLAG...1=INDEX >VIA, 2=INDEX <VIA
4339 REM                                     3=RETRACT <VIA, 4=RETRACT
4340 REM  EC = ENCODER CONVERSION FACTOR....COUNTS TO RADIANS
4345 REM  EO = ENCODER OFFSET (RADIANS)...USED TO CORRECT TIMING BELT
4346 REM       POSITION
4350 REM  F1 = X-COMPONENT OF NIP FORCE (LBS)
4355 REM  F2 = Y-COMPONENT OF NIP FORCE (LBS)
4360 REM  FF = FORCE CONTROL FLAG...0=NOT IN FORCE CONTROL..1=FORCE CONTROL
4362 REM  FR = TEST DISTANCE VALUE
4363 REM  FS = STOP FLAG
4365 REM   I = ?
4370 REM  ID = INITALIZATION MODE FLAG...ID=1..VARIABLES NOT INITIALIZE
4375 REM       ID=2 VARIABLES INITIALIZED
4380 REM  IS = INDEX WHEN STOPPED FLAG....0=NOT INDEXING...1=INDEXING
4385 REM  IV$ = INDEX VALIDATION ....."INDEX" OR "NO INDEX"
4390 REM
4392 REM  LD = MAX. NIP FORCE (LBS)
4393 REM  LF = FINAL CONSTANT SPEED POSITION
4395 REM  LS = LINK POSITION (RADIANS) - DYNAMIC....0=ENVELOPER SIDE
4396 REM  LT = START POSITION OF LINK MOTION
4397 REM  ML = MAX. ALLOWABLE COMPONENT LOAD SO AS NOT TO EXCEED
4398 REM       250# RESULTANT
4400 REM  MT = MOVE TIME (SECS.) FROM START TO VIA OR VIA TO RETRACT
4401 REM       (& VISA VERSA)
4405 REM  MS = MAXIMUM GEAR BOX OUTPUT SPEED IN RADIANS PER SECOND
4410 REM  NP = NIP FORCE SIGNAL (COUNTS)....0 - 4095
4415 REM  OI = ULTRASONIC SENSOR OFFSET (CORRECTION)
4420 REM  P0 = POSITION OF LINK CD WHEN RIDER   LL IS ON FILM SURFACE
4421 REM       (RADIANS)
4425 REM  P1 = VIA POINT POSITION IN RADIANS--LINK CD POSITION
4430 REM  P2 = FULL RETRACT POSITION IN RADIANS--LINK CD POSITION
4435 REM  P3 = MIN. POSITION FOR LINK CD (RADIANS)
4440 REM  P4 = MAX. ROSITION FOR LINK CD (RADIANS)
4445 REM  P5 = LINK CD POSITION WHEN ROLL AT 10" CORE (RADIANS)
4450 REM  PH = PHI
4455 REM  PI = 3.1415927
4460 REM  RA = ACTUAL ROLL RADIUS (IN)
```

```
4465 REM  RI =ROLL RADIUS INCREMENT...USED FOR OFFSETTING INDEX TARGET
4470 REM  RP$= "CORE" OR "NO CORE" INDICATOR
4475 REM  RR = ROLL RADIUS (IN)
4480 REM  RS = RETRACT WHEN STOPPED FLAG...0=NOT RETRACTING..1=RETRACTING
4485 REM  RT = SQUARE ROOT OF
4490 REM  RV$= RETRACT VALIDATION ...."RETRACT" OR "NO RETRACT"
4500 REM  S1 = THETA 1 (ANGLE OF LINE CONNECTING CRANKS "C" AND "A"...C
4505 REM       0=+X-AXIS)
4510 REM  S3 = THETA 3
4515 REM  S4 = THETA 4 (LINK CD POSITION IN RADIANS)
4520 REM  S8 = THETA 4 AS ABOVE BUT WITH COORDINATES SHIFTED 180 DEGREE
4525 REM  S9 = FINAL POSITION OF LINK CD...RIDER ROLL AT ROLL SURFACE
4526 REM       (RADIANS)
4530 REM  SF = FINAL POSITION OF LINK CD...RIDER ROLL AT ROLL SURFACE
4531 REM       (RADIANS)
4535 REM
4540 REM  TG = TIMER PRESET (AND REMAINING SECONDS)
4545 REM  T5 = DYNAMIC TIME OR COUNT DOWN VALUE (SECONDS)
4550 REM  T7 = TIMER PRESET (SECONDS)
4555 REM  TU = TURRET OFFSET (RADIANS)
4560 REM
4565 REM  TZ = TIME FOR CONSTANT SPEED MOTION
4570 REM  V  = VELOCITY SETPOINT IN RADIANS PER SECOND
4575 REM       (GETS CONVERTED AS VS%)
4580 REM  VF = FINAL CONSTANT VELOCITY SETPOINT IN RADIANS PER SECOND
4583 REM  VI = LOCATION STOP OR VIA POINT FLAG...1=INDEX/VIA,2=RETRACT/VIA
4584 REM       3=RETRACTING/FULL RETRACT, 4= INDEXING/ROLL SURFACE
4585 REM  WR = ROLL WEIGHT + WEIGHT OF BRACKETS INBOARD OF LOAD CELLS
4590 REM
4595 REM
4600 REM
4605 REM          TURRET ENCODER MUST BE INSTALLED SUCH THAT
4610 REM          0 DEGREES IS TOWARDS LOAD/UNLOAD SIDE
4615 REM          (7P RESOLVER AND THIS SOFTWARE MUST COINCIDE...VERIFY
4620 REM
4625 REM          LINK ENCODER MUST BE INSTALLED SUCH THAT
4630 REM          0 DEGREES IS TOWARDS TURRET CENTER
4635 REM
4640 REM
4645 REM
4650 REM
4655 REM
4670 REM  LINE 4999 IS THE DESIGNATED DUTEC START-UP LINE (REQUIRED)
4675 REM
4680 REM  *****DO NOT*****USE A VARIABLE NAMED T8 IN PROGRAM....
4685 REM  ...EXCEPT ON START-UP LINE
4690 REM
4695 REM
4700 REM
4705 REM
4710 REM
4711 REM
4715 REM
4720 REM
4725 REM
4730 REM
4735 REM
4999 POKE 4,3:POKE 5,208:T8=USR(0):T8=0
5000 REM
5003 REM   IDLE MODE
5004 REM AMPLIFIER=DISABLED,BRAKE=ENGAGED,SPEED=ZERO,MODE=SPEED,CLUTCH
5005 AM%=0:B%=0:VS%=2047:M%=0:CL%=0:FS=0:RS=0:IS=0:FF=0
5006 M%=1:GOSUB 5015
5007 PRINT "IDLE"
5010 GOTO 5005
5015 REM INITIAL VARIABLE VALUES - SUBROUTINE
5017 ID=1:VI=0
5020 RI=2:REM ROLL RADIUS
```

```
5480 I=0
5485 D=1
5500 PI=3.141593
5520 DEF FNAC(Y)=-ATN(Y/SQR(1-Y^2))+PI/2
5530 EO=-0.04503
5532 TU=-0.0419
5545 REM
5560 REM MAX SPEED OF MOTOR= 40 RPM = 4.189 RAD/S
5580 REM AF=1.35
5600 EC=2*PI/4095
5610 P1=233*PI/180: REM 233 = ACTUAL VIA POINT ANGLE (DEGREES)
5620 P2=300*PI/180: REM 300 = FULL RETRACT ANGLE OF LINK CD (313 ACTUAL
5630 P3=317*PI/180
5640 P4=7*PI/180
5650 P5=63*PI/180
5655 D1=333.3
5660 D2=300
5665 LD=SQR(D1^2+D2^2)
5680 WR=75
5690 OI=0.375: REM STEEL THICKNESS ON TEST STAND..MAY BE DIFFERENT ON COATER
5700 S1=311*PI/180
5795 REM INDICATES THAT INITIALIZATION HAS BEEN COMPLETED (ID=2)
5800 ID=2
5860 RETURN
7020 REM 1.28=64/50 ---ENCODER TO SHAFT RATIO
7025 REM 25/32 ....IDLER TO ENCODER RATIO---1/1 ENCODER TO CRANK RATIO
7030 REM
7035 REM
7040 REM MOTION PARAMETERS FOR...INDEXING
7041 VI=0
7042 IF D=-1 THEN 7090
7045 GOSUB 13304:REM  TO CALCULATE S4
7050 LS=LE%*EC+EO
7052 REM
7055 IF LS>P1 THEN DL=LS-P1
7060 IF LS>P1 THEN DM=1
7070 IF LS<=P1 THEN DL=LS-S4
7075 IF LS<=P1 THEN DM=2
7085 REM
7087 GOTO 7145
7090 REM MOTION PARAMETERS FOR...RETRACTING
7095 VI=0
7100 LS=LE%*EC+EO
7102 REM
7110 IF LS>=P1 THEN DL=P2-LS
7115 IF LS>=P1 THEN DM=4
7120 IF LS<P1 THEN DL=P1-LS
7125 IF LS<P1 THEN DM=3
7135 REM
7145 PRINT LS*180/PI;"=START POSITION IN DEG."
7147 IF FS=1 THEN RETURN
7149 LS=LE%*EC+EO
7160 V=0.1
7330 VS%=(2047/MS)*V*D+2047
7335 IF LS<SF AND DM=2 THEN VI=4
7340 IF LS>P2 AND DM=4 THEN VI=3
7346 IF LS<P1 AND DM=1 THEN VI=1
7347 IF LS>P1 AND DM=3 THEN VI=2
7348 IF VI>0 AND VI<5 THEN 7370
7350 GOTO 7147
7370 VS%=2047: REM SPEED=0
7375 IF VI=1 THEN 8000
7380 IF VI=2 THEN 12000
7470 RETURN
8000 REM SUBROUTINE TO INDEX WHEN MACHINE STOPPED
8040 IS=1
8050 LS=LE%*EC+EO
8060 IF LS<P1 THEN 8120
```

```
8078 REM ENGAGE CLUTCH "A"
8080 CL%=1
8100 GOTO 8175
8120 REM ...ENGAGE CLUTCH "C", SET SPEED =0RPM=2047 COUNTS,
8122 REM ...SWITCH TO SPEED MODE,ENABLE AMP,DISENGAGE BRAKE
8125 CL%=0
8175 VS%=2047
8180 M%=0:AM%=1:B%=1
8205 D=1:REM    DIRECTION = INDEX
8207 IF VI=1 THEN 7040
8210 GOSUB 7040
8300 REM ENSURE CLOSE PROXIMITY FOR FORCE CONTROL *** 5 DEGREES
8400 IF FS=1 THEN RETURN
8406 IF LS>SF THEN 8210: REM WAS ABS(LS-P0)>5*PI/180
8410 IS=0
8415 REM RETURN: REM THIS LINE NEEDED UNTIL LOAD CELLS ARE CALIBRATED
8417 REM OTHERWISE PROGRAMS NEXT STEP WOULD BE FORCE CONTROL
8420 GOTO 9210:REM FORCE CONTROL...FOR NO DELAY GOTO 9975
8440 RETURN
9195 REM FORCE CONTROL SUBROUTINE
9210 VS%=2047
9230 B%=0
9250 AM%=0
9255 REM  DELAY HERE TO GIVE AMP TIME TO STABILIZE
9257 GOSUB 15000
9260 M%=1
9265 REM MAY NEED DELAY
9280 AM%=1:B%=1:CL%=0
9975 REM NIP FORCE CALCULATION
9980 FF=1
9982 IF FS=1 THEN RETURN
9985 S4=LE%*EC+EO
10000 AD=SQR(53.7615-53.3064*COS(2*PI+(S4-S1)))
10020 B3=FNAC((-6.981-AD^2)/(-11.022*AD))
10040 B4=FNAC(AD/11.566)
10060 IF S1<=S4 AND S4<=311*PI/180 THEN 10100
10080 GOTO 10140
10100 S3=S4-(B3+B4)
10120 GOTO 10160
10140 S3=S4-ABS(B3-B4)
10160 PH=TE%*EC+TU+S3+PI*(1+68.6/180)
10162 IF FS=1 THEN RETURN
10165 XF=D1/1980*(FX%+18)-D1
10166 PRINT FX%+18
10170 YF=D2/2057*FY%-D2
10172 PRINT "FY%=";FY%
10175 PRINT "XF=";XF,"YF=";YF
10176 PRINT "FY%=";FY%
10180 F1=XF*COS(PH)-YF*SIN(PH)
10200 F2=XF*SIN(PH)+YF*COS(PH)+WR
10205 XF=F1*COS(PH)+F2*SIN(PH)
10210 YF=-F1*SIN(PH)+F2*COS(PH)
10220 NP=(SQR(XF^2+YF^2)/LD)*4095
10222 NP=NP*4095/702
10223 REM   702=EQUIVALENT COUNT FOR A 75# LOAD....4095/702 SCALE FACTO
10224 REM   PROVIDES 4 TO 20MA OUTPUT FOR 0 TO 75# NIP FORCE
10225 IF NP>4095 THEN NP=4095
10230 NP%=NP
10240 REM
10245 IF FS=1 THEN RETURN
10260 GOTO 9980
10265 REM END NIP FORCE CALCULATION
11999 REM
12000 REM SUBROUTINE TO RETRACT WHEN THE RIDER ROLL IS STOPPED
12020 RS=1
12030 LS=LE%*EC+EO
12040 IF LS>P1 THEN 12160
12080 CL%=0
```

```
12120 GOTO 12300
12160 CL%=1
12300 VS%=2047:M%=0:AM%=1
12310 B%=1: REM   B%=1 MEANS BRAKE IS DISENGAGED
12315 D=-1:REM   DIRECTION = RETRACT
12317 IF VI=2 THEN 7040
12320 GOSUB 7040: REM ACCEL/DECEL ALGORITHM
12330 REM ENSURE FULL RETRACT POSITION ATTAINED *** 5 DEGREES
12332 IF FS=1 THEN RETURN
12335 IF (P2-LE%*EC+EO)>(5*PI/180) THEN GOTO 12320
12340 B%=0:AM%=0:VS%=2047
12360 RS=0
12380 RETURN
12385 REM END OF RETRACT WHEN STOPPED SUBROUTINE
12999 REM     EQUATIONS TO CALCULATE S4,S8,SF, & S9 BASED ON ULTRASONIC
13000 REM     S4=FINAL ANGLE OF LINK CD FOR RIDER ROLL
13002 REM     CONTACT WITH WINDING ROLL
13304 RR=(UD%/2097)*1000/25.4+OI+RI
13305 FR=261:REM FOR TEST PURPOSES...FRAME ALL THE WAY BACK...DIA. SIMULATOR
13306 RR=(FR/2097)*1000/25.4+OI+RI:REM .. USE UR INSTEAD OF FR IN ACTUAL USE
13307 RA=RR+RI
13308 REM     1/4" TOLERANCE ON ROLL RADIUS...MIN RR ACTUALLY=5
13310 IF RR>=4.75 AND RR<9.18 THEN S8= 212.3113*EXP(2.695773E-02*RR)
13315 IF RA>=4.75 AND RA<9.18 THEN S9= 212.3113*EXP(2.695773E-02*RA)
13320 IF RR>=9.18 AND RR<12.8 THEN S8= 204.2947*EXP(3.093216E-02*RR)
13325 IF RA>=9.18 AND RA<12.8 THEN S9= 204.2947*EXP(3.093216E-02*RA)
13340 IF RR>=12.8 AND RR<15.35 THEN S8= 188.8761*EXP(3.717715E-02*RR)
13345 IF RA>=12.8 AND RA<15.35 THEN S9= 188.8761*EXP(3.717715E-02*RA)
13350 IF RR>=15.35 AND RR<17.6 THEN S8= 76.26961*RR^.5411471
13355 IF RA>=15.35 AND RA<17.6 THEN S9= 76.26961*RA^.5411471
13360 IF RR>=17.6 AND RR<=20 THEN S8=-174.7724+9.934501*RR
13365 IF RA>=17.6 AND RA<=20 THEN S9=-174.7724+9.934501*RA
13367 RP$="CORE"
13368 IF RR<4.75 THEN RP$="NO CORE"
13370 REM     CONVERT FROM DEGREES TO RADIANS & 180 DEG. COORDINATE SHI
13375 IF S8>=180 THEN S4=S8-180
13378 IF S9>=180 THEN SF=S9-180
13380 IF S8<180 THEN S4=S8+180
13382 IF S9<180 THEN SF=S9+180
13385 S4=S4*PI/180
13386 P0=S4
13387 SF=SF*PI/180
13388 PRINT "SF=";SF*180/PI
13390 RETURN
14000 REM INTERRUPT HANDLER FOR STOP
14030 REM CANNOT STOP R.R. WHEN IN FORCE CONTROL....MUST FIRST RETRACT
14040 IF FF=1 THEN RETURN
14050 VS%=2047:AM%=0:B%=0
14055 FS=1
14060 RETURN
14200 REM INTERRUPT HANDLER FOR RETRACT
14205 IF IS=1 THEN RETURN
14210 IF RS=1 THEN RETURN
14220 IF ID<>2 THEN GOSUB 5015
14230 GOSUB 14600
14235 IF RV$="NO RETRACT" THEN RETURN
14240 AM%=0:B%=0:IS=0:FF=0
14250 GOSUB 15000
14278 GOSUB 12000
14280 RETURN
14400 REM INTERRUPT HANDLER FOR INDEX
14405 REM ASSURES INITILIZATION OF CONTROL CONSTANTS (LINE 14433)
14425 REM   IF INDEX OR FORCE CONTROL IN PROGRESS THEN
14426 REM   RETURNS TO WHERE IT LEFT OFF AFTER INTERRUPT (LINE 14430)
14428 IF RS=1 THEN RETURN
14430 IF IS=1 OR FF=1 THEN RETURN
14433 IF ID<>2 THEN GOSUB 5015
14435 REM   DISABLE AMP.,ENGAGE BRAKE,RETRACT WHEN STOPPED FLAG
```

```
14436 REM   SET TO 0...STATUS AT THIS POINT IN PROGRAM (14465)
14440 GOSUB 14600
14450 IF IV$="NO INDEX" THEN RETURN
14455 REM .....IF IS=1 THEN INDEX IS IN PROGRESS
14465 AM%=0:B%=0:RS=0
14470 GOSUB 15000
14475 GOSUB 8000
14485 RETURN
14600 REM POSITION VALIDATION
14605 GOSUB 13304
14610 LS=LE%*EC+EO:REM CURRENT POSITION IN RADIANS
14615 IV$="":RV$=""
14616 REM RETURN (USED DURING TESTING ONLY)
14620 IF LS<P4 OR LS>P3 THEN IV$="NO INDEX"
14630 IF LS<P4 OR LS>P3 THEN FL$="LINK CD IN ILLEGAL POSITION"
14632 IF LS<S4 THEN IV$="NO INDEX"
14633 IF LS<S4 THEN RV$="NO RETRACT"
14634 IF LS<S4 THEN FL$="LINK CD IN ILLEGAL POSITION"
14640 IF RP$="NO CORE" THEN IV$="NO INDEX"
14650 IF LS>=P2 OR LS<=P4 THEN RV$="NO RETRACT"
14660 IF LS>=P2 OR LS<=P4 THEN FL$="LINK CD IN ILLEGAL POSITION"
14700 RETURN
15000 REM DELAY
15010 T7=.5
15020 REM .5 SECOND DELAY ....T7=.5
15030 IF T7>0 THEN GOTO 15020
15050 RETURN
```

What is claimed is:

1. An apparatus for supporting ends of a wind-up lay-on roll while the roll applies a substantially uniform contact force across a width of web material being wound into a roll having an axis, the apparatus comprising:

a first four bar linkage assembly and a second four bar linkage assembly, one of the linkage assemblies for connecting each end of the wind-up lay-on roll to a support and adapted to move such that movement of the ends of the wind-up lay-on roll is confined in a substantially radial direction from the web roll axis when the wind-up lay-on roll is in contact with the width of an outer surface of the web roll;

a force sensor for sensing and forming a signal representative of the force being applied to each end of the wind-up lay-on roll;

a position sensor for sensing and forming a signal representative of an angular position of a link or crank in one of the linkage assemblies;

a position sensor for sensing and forming a signal representative of a position of the outer surface of the web roll; and means responsive to the force signals and the position signals for moving the linkage assemblies such that the wind-up lay-on roll applies a substantially uniform force across the width of the web material being wound into the roll.

2. The apparatus of claim 1, further comprising:

a turret assembly having a first arm and a second arm, the first linkage assembly rotatably connecting a first end of the wind-up lay-on roll to the first arm and the second linkage assembly rotatably connecting a second end of the wind-up lay-on roll to the second arm; and a turret position sensor for sensing and forming a signal representative of the angular position of one of the arms of the turret assembly, and wherein the moving means responsive to the force signals and the position signals is also responsive to the signals from the turret position sensor.

3. The apparatus of claim 1, wherein each one of the linkage assemblies comprises:

a first stationary support;

a first shaft rotatably connected to the first support;

a first crank having a first end and a second end, the first crank first end connected to the first shaft;

a second shaft rotatably connected to the first support;

a second crank having a first end and a second end, the second crank first end connected to the second shaft; and a link having a first end, a middle portion and a second end, the link first end rotatably connected to one end of the wind-up lay-on roll, the link middle portion rotatably connected to the first crank second end and the link second end rotatably connected to the second crank second end, such that when the wind-up lay-on roll is rotatably connected to the link first ends, the wind-up lay-on roll moves in the substantially radial direction when the first shaft and the second shaft rotate through a predetermined angular range and when the first shaft and the second shaft rotate beyond the predetermined angular range then the wind-up lay-on roll moves away from the web roll deviating from the radial direction to a retracted position.

4. The apparatus of claim 3, wherein the moving means comprises:

means for rotating either the first shaft or the second shaft; and a control system for processing the force signals and the position signals and for controlling the rotating means such that the torque applied to either the first shaft or the second shaft causes the wind-up lay-on roll to apply a substantially uniform pressure across the width of the web material being wound into the roll.

5. The apparatus of claim 4, wherein the control system comprises:

means connected to receive signals from the sensors for processing the signals and calculating an actual contact force between the web roll and the lay-on roll; and means for comparing the actual contact force to a preset force and for sending control signals to the rotating means to maintain the contact force between the web roll and the lay-on roll substantially constant.

6. The apparatus of claim 5, wherein the rotating means comprises:

an adjustable motor assembly connected to rotate a rotatable motor assembly shaft;

a first clutch assembly and a second clutch assembly connected to the motor assembly shaft;

means connected between the first clutch assembly and the first shaft for rotating the first shaft when the motor assembly shaft rotates;

means connected between the second clutch assembly and the second shaft for rotating the second shaft when the motor assembly shaft rotates, a brake adapted to slow down, stop or prevent the movement of the linkage assemblies; and the control system connected to control the motor assembly, the first and second clutch assemblies and the brake such that (1) the control signals control torque applied by the motor on the motor shaft, (2) when the motor applies a torque on the motor assembly shaft and the first clutch assembly is engaged, the first shaft applies a torque on the first crank, the link, the second crank and the wind-up lay-on roll, and (3) when the motor applies a torque on the motor assembly shaft and the second clutch assembly is engaged, the second shaft applies a torque on the second crank, the link, the first crank and the wind-up lay-on roll.

7. The apparatus of claim 1, wherein each one of the force sensors is adapted to sense force in two perpendicular directions, both directions perpendicular to an axis of rotation of the wind-up lay-on roll.

8. The apparatus of claim 1, further comprising:

a wind-up lay-on roll supported by the first linkage assembly and the second linkage assembly.

9. The apparatus of claim 1, further comprising:

a turret assembly including a base and a pair of arms rotatably connected to the base about a turret arm axis of rotation, the first linkage assembly rotatably connecting a first end of the wind-up lay-on roll to the first arm and the second linkage assembly rotatably connecting a second end of the wind-up lay-on roll to the second arm; and a web roll core having a core axis of rotation, the core rotatably connected to the turret arms such that the core is adapted to rotate about the core axis and the turret arm axis.

10. The apparatus of claim 9, further comprising:

a position sensor for sensing and forming a signal representative of the angular position of the turret arms; and the moving means is also responsive to the signal representative of the position of the turret arms.

* * * * *